US007841395B2

(12) United States Patent
Gay et al.

(10) Patent No.: US 7,841,395 B2
(45) Date of Patent: Nov. 30, 2010

(54) ELECTRIC SUBMERSIBLE PUMP (ESP) WITH RECIRCULATION CAPABILITY

(75) Inventors: Farral D. Gay, Joseph, UT (US); Kevin R. Bierig, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 313 days.

(21) Appl. No.: 11/962,993

(22) Filed: Dec. 21, 2007

(65) Prior Publication Data

US 2009/0159262 A1 Jun. 25, 2009

(51) Int. Cl.
*E21B 43/00* (2006.01)
*E21B 36/00* (2006.01)

(52) U.S. Cl. ..... 166/105; 166/57; 166/302; 166/369; 417/423.8

(58) Field of Classification Search ..... 166/104, 166/105, 369, 302, 57; 417/423.8
See application file for complete search history.

(56) References Cited

U.S. PATENT DOCUMENTS

| | | | | |
|---|---|---|---|---|
| 2,280,087 | A | 4/1942 | Hollander et al. | |
| 2,310,757 | A | 2/1943 | Wagner | |
| 2,809,590 | A | 10/1957 | Brown | |
| 2,980,184 | A * | 4/1961 | Reed | 166/57 |
| 4,372,389 | A * | 2/1983 | Hamrick et al. | 166/369 |
| 4,487,257 | A | 12/1984 | Dauphiné | |
| 4,553,909 | A | 11/1985 | Galais et al. | |
| 4,580,634 | A | 4/1986 | Cruise et al. | |
| 4,582,131 | A | 4/1986 | Plummer et al. | |
| 4,616,704 | A | 10/1986 | Johnston | |
| 4,643,258 | A | 2/1987 | Kime | |
| 4,749,034 | A | 6/1988 | Vandevier et al. | |
| 4,913,239 | A | 4/1990 | Bayh, III | |
| 4,981,175 | A | 1/1991 | Powers | |
| 5,554,897 | A | 9/1996 | Martin et al. | |
| 5,845,709 | A | 12/1998 | Mack et al. | |
| 6,260,627 | B1 * | 7/2001 | Rivas | 166/369 |
| 6,322,331 | B1 | 11/2001 | Swatek et al. | |
| 7,134,499 | B2 * | 11/2006 | Wilson et al. | 166/369 |
| 7,188,669 | B2 | 3/2007 | Bullock et al. | |
| 2005/0109516 | A1 * | 5/2005 | Wilson et al. | 166/369 |

(Continued)

FOREIGN PATENT DOCUMENTS

| | | |
|---|---|---|
| SU | 668607 | 6/1979 |

(Continued)

OTHER PUBLICATIONS

Cramer, R.W., et al.; Development and Application of a Downhole Chemical Injection Pump for Use in ESP Applications; Society of Petroleum Engineers; SPE 14403; copyright 1985.

(Continued)

*Primary Examiner*—Jennifer H Gay
(74) *Attorney, Agent, or Firm*—Bracewell & Giuliani LLP

(57) ABSTRACT

A submersible pumping system for use downhole, wherein the system includes a first pump, a second pump, a recirculation coupling between the first and second pumps, and a recirculation line for directing cooling flow across the pump motor. The pumps and coupling are independent modular items connected together. Optionally, a multi-stage pump may be retrofitted with the coupling for creating a cooling flow.

14 Claims, 4 Drawing Sheets

U.S. PATENT DOCUMENTS

2009/0159262 A1* 6/2009 Gay et al. ..... 166/105

FOREIGN PATENT DOCUMENTS

| | | |
|---|---|---|
| SU | 1476199 | 4/1989 |
| SU | 1652470 | 5/1991 |

OTHER PUBLICATIONS

Wilson et al., Operating Electrical Submersible Pumps Below the Perforations, SPE Production & Facilities, May 1998, p. 141-145.

Knight et al., Implementing Recirculation System ESPs in Gaines County, Texas, SPE 52158, 1999, p. 1-7.

Gaddis et al., Custom Recirculation ESP System in 7-in. Casing Increases Indian Basin Gas Well Production, SPE 75711, 2002, p. 1-8.

International Search Report and Written Opinion, dated Jul. 20, 2009, 12 pages.

* cited by examiner

ELECTRIC SUBMERSIBLE PUMP (ESP) WITH RECIRCULATION CAPABILITY

BACKGROUND

1. Field of Invention

The present disclosure relates to downhole pumping systems submersible in well bore fluids. More specifically, the present disclosure concerns recirculating a portion of the flow pumped by a submersible pump of a downhole pumping system to the intake of the pumping system.

2. Description of Prior Art

Submersible pumping systems are often used in hydrocarbon producing wells for pumping fluids from within the wellbore to the surface. These fluids are generally liquids and include produced liquid hydrocarbon as well as water. One type of system used in this application employs an electrical submersible pump (ESP). ESPs are typically disposed at the end of a length of production tubing and have an electrically powered motor. Often, electrical power may be supplied to the pump motor via wireline. Typically, the pumping unit is disposed within the well bore just above where perforations are made into a hydrocarbon producing zone. This placement thereby allows the produced fluids to flow past the outer surface of the pumping motor and provide a cooling effect.

In some situations the submersible pumping systems are disposed in a wellbore where the pump intale is below the perforations. In this situation, fluid flowing from the producing zone reaches the pump inlet before passing by the motor. As such the produced fluid is pumped to the surface without first cooling the motor. To provide cooling to the pump motor, an ESP system may comprise multiple pumps and a recirculation line that directs flow from the discharge of a lower pump to below the motor.

SUMMARY OF INVENTION

The present disclosure includes a downhole submersible pumping system disposable in a cased wellbore. The system comprises a lower pump an upper pump, a pump motor in cooperation with the lower pump and upper pump, a seal section, a recirculation coupling connected on one end to the lower pump discharge and on the other end to the upper pump intake. The system also includes a recirculation line having an intake in fluid communication with the recirculation coupling and an exit configured to discharge fluid from the recirculation line onto the pump motor. The recirculation coupling is formed first as a modular independent component and then connected to the lower pump and upper pump. The cooperation between the pump motor and pumps may comprise a shaft extending from the pump motor to both pumps and configured to rotate impellers disposed within the pumps. The recirculation coupling is configured to receive fluid discharged from the lower pump and to direct a portion of the received fluid to the upper pump intake and the remaining portion of the received flow to the recirculation line. Optionally, the lower pump and upper pump originally comprise a part of a multi-stage pumping system and wherein the multi-stage pumping system is retrofitted to include the recirculation coupling between the lower pump and the upper pump.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be through and complete, and will fully convey the scope of the invention to those skilled in the art. Like numbers refer to like elements throughout.

The present disclosure provides embodiments of a downhole submersible pumping system for producing fluids from within a wellbore up to the surface. More specifically, the downhole submersible pumping system described herein includes a system for recirculating flow from the pump discharge to below the pump motor. The recirculating fluid flows across the pump motor and absorbs heat therefrom as the fluid is drawn to the pump inlet.

Figure 1:
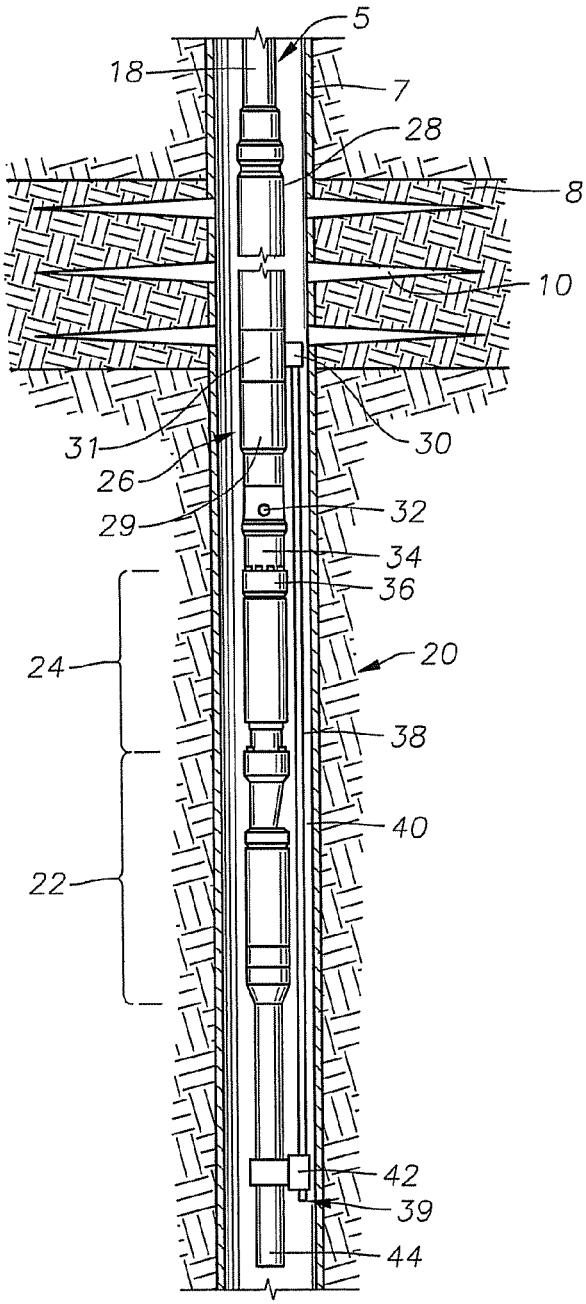
FIG. 1 shows a side view of a downhole submersible system in accordance with the present disclosure.

Referring now to FIG. 1, one example of an electrical submersible pumping system is shown in side view disposed in a wellbore 5. The electrical submersible pumping system 20 comprises a pump section 26. The pump section 26 includes an upper pump 28, a lower pump 29, with a recirculation coupling 31 disposed between these two pumps (28, 29). The pumps (28, 29) are centrifugal pumps, each having multiple stages of diffusers and impellers. The electrical submersible pumping system 20 also includes an equalizer section 24 and a motor section 22; where the motor section 22 is disposed just below the equalizer section 24. The equalizer section 24 provides pressure equalization between lubricant in the motor section 22 and the ambient well fluid. Bolts 36 are shown coupling the upper end of the equalizer section 24 to the bottom end 34 of the pumping section 26.

In one embodiment, both the upper and lower pumps (28, 29) comprise independent stand alone pumps that are coaxially connected by the coupling 31 as shown. For the purposes of this disclosure, the term "independent stand alone pumps" refers to standard submersible pumps used for pumping fluids from within a wellbore. Thus, each the upper and lower pump (28, 29), although combined into a single unit, are capable of pumping from within a wellbore without the need for an additional pump. Similarly, in one embodiment the recirculation coupling 31 is also a modular self standing unit formed independent of either the upper or lower pump (28, 29) and later affixed to these pumps as illustrated in FIG. 1.

In one mode of operation of the electrical submersible pumping system 20 of FIG. 1 comprises disposing the pumping system 20 within a wellbore 5. In this embodiment the wellbore 5 includes casing 7 lining the substantial length of the wellbore 5. The wellbore 5 includes perforations 10 that extend through the casing 7 and into an adjoining subterranean producing zone 8 that surrounds a portion of the wellbore 5. Production fluid, in the form of liquid hydrocarbons, flows from the zone 8 through the perforations 10 and into the wellbore 5.

The motor 22 provides a rotational motive force on the pumps (28, 29) for rotating impellers disposed therein thereby urging production fluid into the pumping system 20. In this embodiment a single shaft (not shown in FIG. 1) extends from pump 28 to pump 29. Using a single shaft instead of dedicated shafts significantly reduces machining time and cost. A pump inlet 32 is provided on the lower side of the pumping system 20 for allowing production fluid into the system 20. As shown the pump motor 22 is disposed below the perforations 10 and below the pump intake 32. Accordingly, the production fluid makes its way from the formation 8 and perforations 10 into the pump intake 32 without contacting the pump motor 22 surface. Thus the production fluid flowing straight to the intake 32 from the perforations 10 cannot cool the pump motor 22.

The embodiment of FIG. 1 also includes a recirculation system comprising the recirculation coupling 31 in fluid communication with a recirculation line (or tube) 38. A recirculation fluid tap 30 provides fluid communication from the recirculation coupling 31 to the recirculation line 38. The entrance to the recirculation line 38 is at the wall of the recirculation coupling 31. The fluid tap 30 includes a port (shown in FIGS. 2 and 3B as port 72) formed through the recirculation coupling 31. Included with the recirculation system is a recirculation line exit 39 configured to discharge production fluid below the pump motor 22. Due to the localized low pressure produced at the pump inlet or intake 32, any recirculating production fluid inserted into the wellbore by the recirculation line 38 (via the line exit 39) will be drawn up the wellbore 5. The recirculating production fluid flows up the wellbore annulus 40 between the pumping system 20 and the inner circumference of the casing 7 and across outer surface of the pump motor 22. Since the production fluid that passes over the pump motor 22 cools the motor, providing fluid communication between the recirculation coupling 31 and downhole of the pump motor 22 provides the required cooling needed to operate the pump motor 22 within the subterranean wellbore 5. Optionally, a clamp 42 may be used to connect the lower end of the recirculation line 38 to an extension tube 44; where the extension tube 44 extends downward in the wellbore 5 from the bottom end of the motor section 22.

The portion of the produced fluid that flows into the pump intake 32 is urged upwards from the lower pump 29 through the exit of the recirculation coupling 31 into the intake of the upper pump 28. The upper pump 28 further pressurizes the production fluid where it is discharged from the upper pump into associated production tubing 18 for delivery to the Earth's surface. Thus the pump intake 32 serves as a pump system fluid inlet for allowing fluid flow to the intake of both the lower pump 29 and the upper pump 28.

Figure 2:
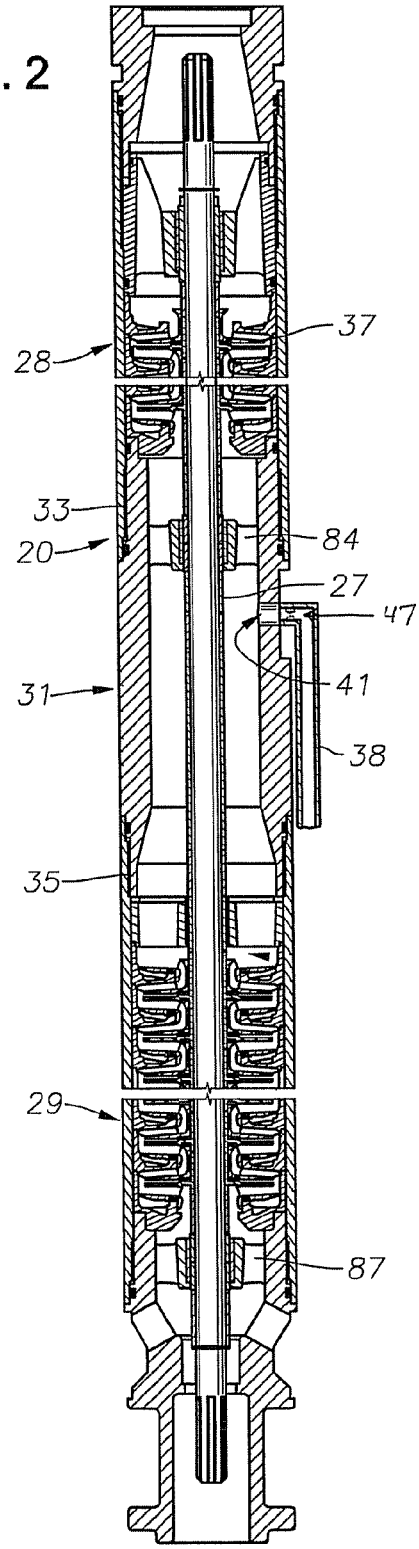
FIG. 2 shows an enlarged cross-sectional view of the pumping system in FIG. 1 in a well bore.

FIG. 2 provides an enlarged cutaway view of an embodiment of an electrical submersible pumping system 20 having an upper pump, recirculation coupling, and lower pump. In this embodiment, upper pump 28 has internal threads 33 on its lower end that engage mating threads on the upper portion of a recirculation coupling 31. Seals may be provided in this threaded coupling between these two elements. Lower pump 29 has internal threads 35 coupled to the lower portion of the recirculation coupling 31. Thus, in this cutaway embodiment, the exit of the recirculation coupling 31 is illustrated communicating with the upper pump 28 intake. Similarly, the recirculation coupling 31 intake communicates with the of the lower pump 29 discharge.

A single integral shaft 27 is shown coaxially disposed within the upper pump 28 and lower pump 29. The shaft 27 is coupled to impellers 37 disposed within the upper pump 28 and optionally a shaft bearing 84 supports and centers the shaft 27 within the upper pump 28. The lower portion of the shaft 27 resides within the lower pump 29 also optionally centered within the lower pump 29 by a corresponding shaft bearing 87. A converging conical plenum 86 describes the space where the lower pump discharge meets the recirculation coupling 31 intake. The recirculation tube 38 is shown connected on its first end to a port 41 formed through the wall of the recirculation coupling 31. An optional orifice 47 may be included for regulating the recirculation fluid flow rate. As shown in the recirculation tube 38 is disposed in the recirculation tubing 38, however it can also be positioned within the port 41. Establishing the orifice size and type varies the pump design and application, however sizing the orifice is within the scope of those skilled in the art. Alternatively, a threaded fitting may be employed for attaching the tubing 38 to the port 41. In such an embodiment, an orifice may be mounted into the fitting. The orifice 47 may comprise a "ferulle" type fitting having a sloping reduced inner diameter. The orifice 47 may also comprise a plate with a reduced diameter opening within the plate for restricting and regulating fluid flow.

Figure 3A:
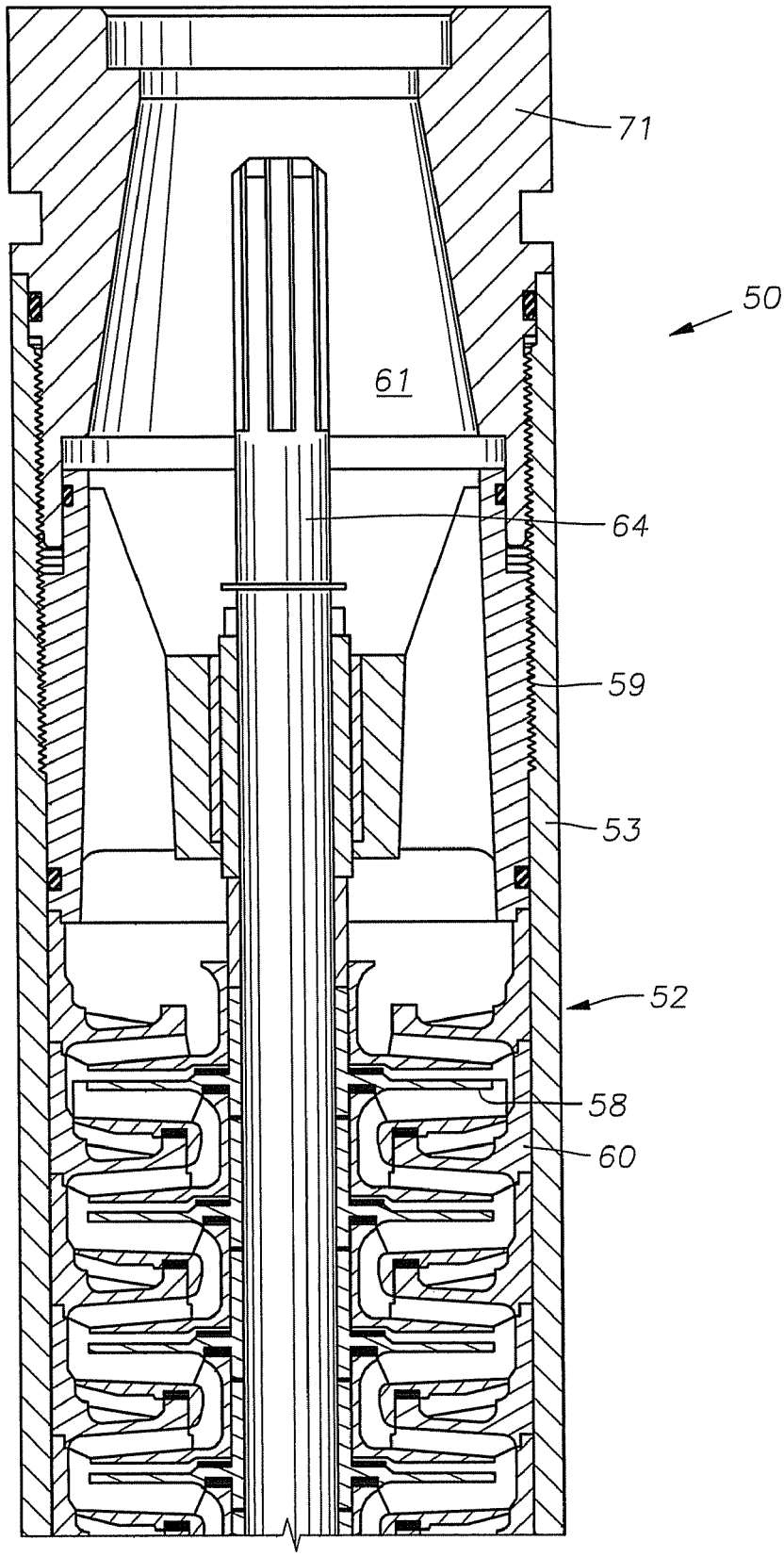
FIGS. 3A-3C show detailed cross-sectional views of a second embodiment of FIG. 1 pumping system.

With reference now to FIG. 3A, a cutaway view of the upper pump section 52 of an alternative embodiment of the electrical submersible pumping system 50 is provided in more detail. As shown in this view, the upper shaft 64 is connected to impellers 58 that rotate within spaces formed in the diffusers 60. The impellers 58 rotate with rotation of the shaft 64. The upper pump section 52 discharges into a discharge head 71. An annulus 61 is formed within the discharge head 71, and is shown tapering inwards as it extends away from the upper portion of the upper pump section 52. The discharge head 71 is shown connected to the upper terminal portion of the upper pump section 52 by a threaded connection 59. However other forms of coupling may be included, such as a flanged bolted fitting. Optional seals are shown for a pressure and fluid seal protecting the inner portions of the pumping system 50 from the wellbore fluid. The upper pump section 52 further comprises a housing 53, where the diffusers 60 are coaxially located along its inner circumference. The housing 53 further includes threads to mate with corresponding threads on the discharge head 71 to form the threaded fitting 59.

Figure 3B:
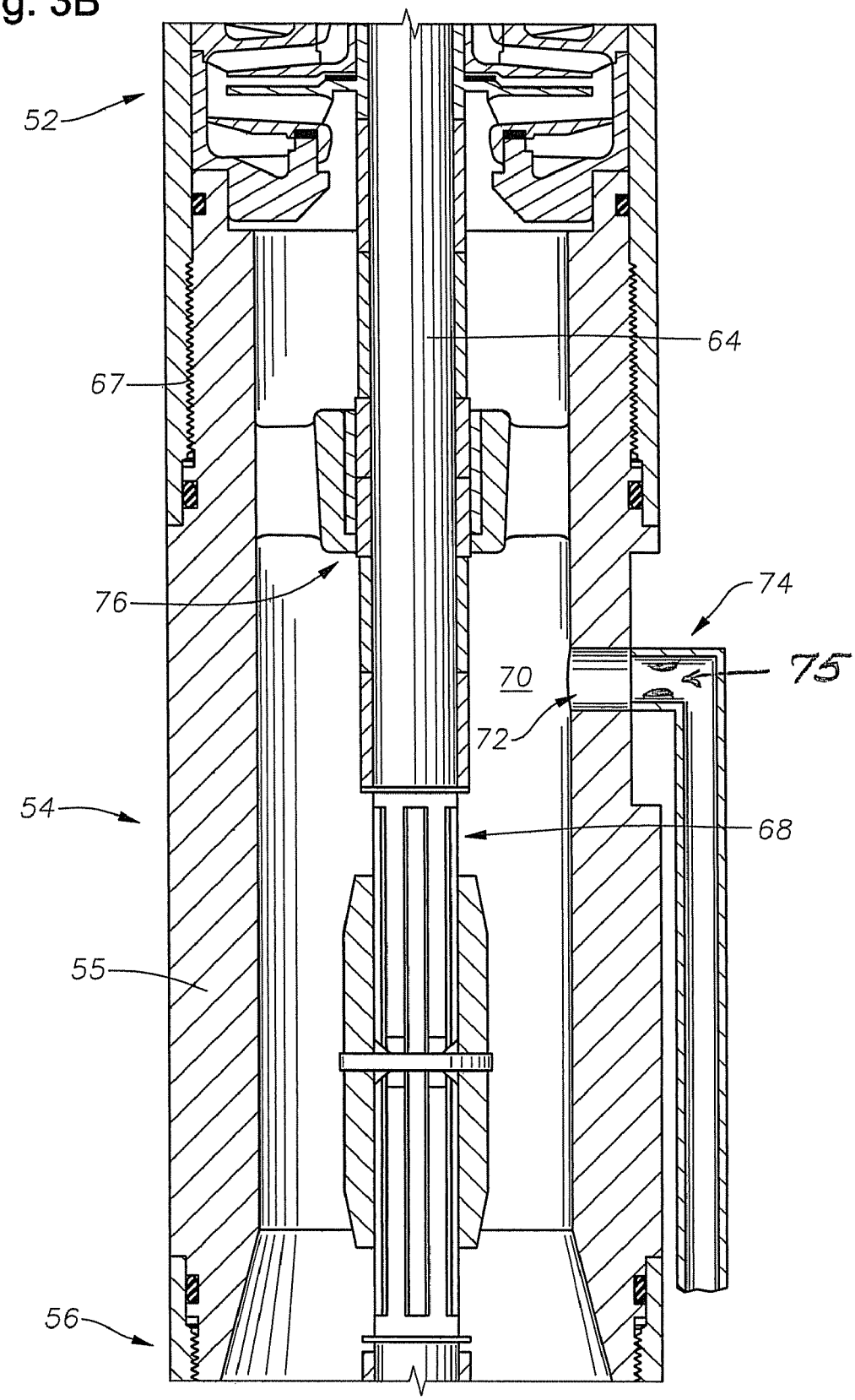

Referring now to FIG. 3B, a cross sectional view of the recirculation coupling 54 is shown in an enlarged illustration. As shown, the upper end of the recirculation coupling 54 is attached to the lower end of the upper pump section 52 by a threaded connection 67. The shaft 64 extends downward from the upper pump section 52 to an optional shaft coupling 68 formed within the inner annulus of the recirculation coupling 54. A housing 55, forming the outer confines of the recirculation coupling has a generally annular configuration leaving a generally hollow space along the axis of the recirculation coupling 54. The annular space 70 also includes a support and bearings 76 formed to receive the upper shaft 64 therein.

In this view, a port 72 is shown formed through the wall of the housing 55 thereby providing for fluid communication between the annular space 70 and the inner circumference of the recirculation tube 74. Accordingly, the port 72 may be configured as a constriction to regulate flow therethrough to supply a requisite amount of cooling fluid from within the annular space to the outer surface of the pump motor 22. The constriction dimensions would depend on the discharge flow of the lower pump 56 and the cooling requirements of the pump motor 22. It is believed it is well within the capabilities of those skilled in the art to create an appropriately sized port to meet these parameters. Optionally, an orifice 75 may be included within the tube 74 for regulating the recirculation flow. Referring now to the lower end of the recirculation coupling 54, the upper end of the lower pump section is shown threadingly coupled thereto.

Figure 3C:
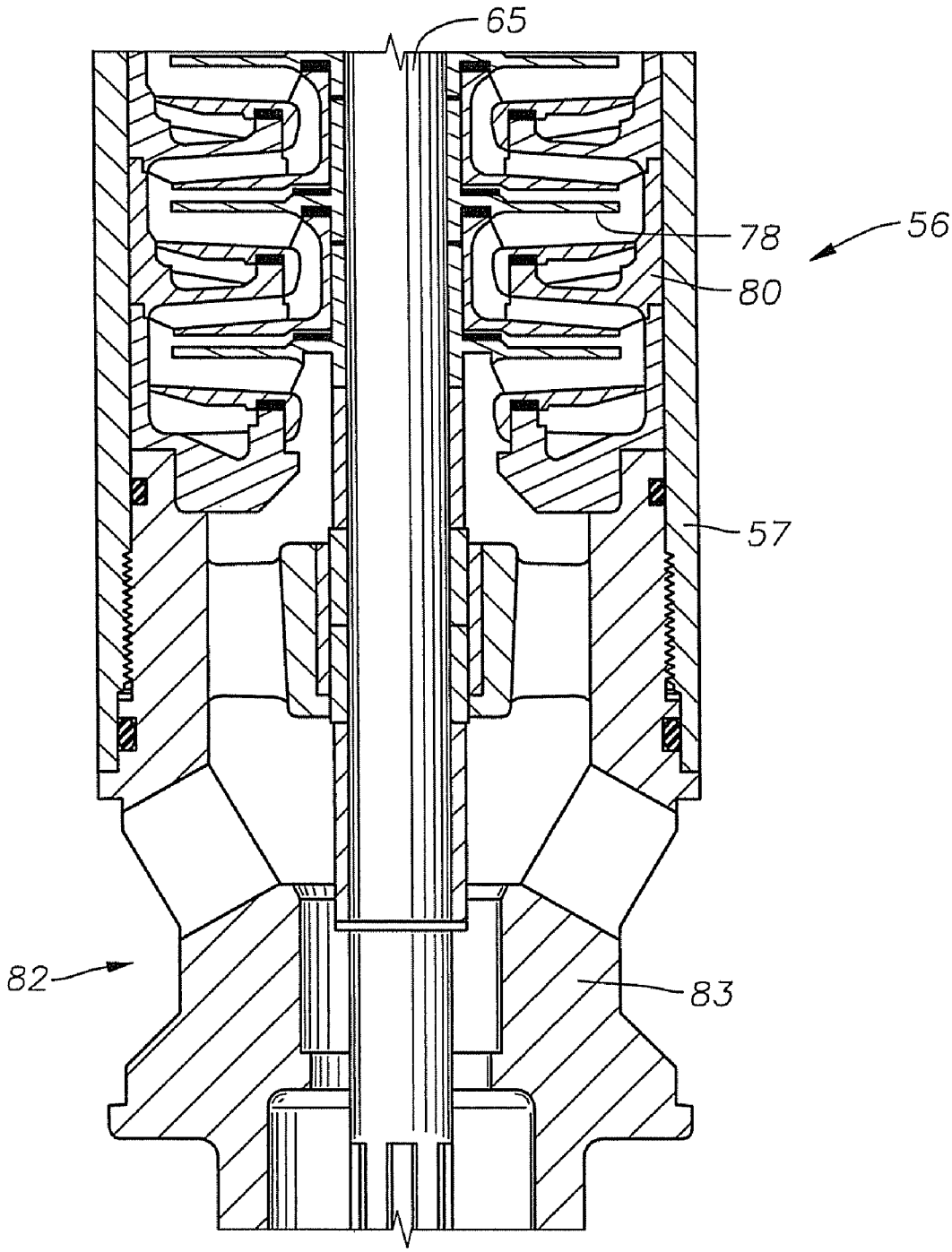

FIG. 3C provides an enlarged cutaway view of an embodiment of the lower pump section 56 of the electrical submersible pump system 50. In this embodiment, the shaft 65, which extends downward from the shaft coupling 68, is shown passing through the lower pump section connecting to each of the impellers 78. The corresponding diffusers 80 are shown residing within the housing 57 of the lower pump section 56. As is known, the combination of the impellers 78 rotating within the diffusers 80 imparts a pressurizing force onto the fluid for urging it into the region above the lower pump section 56. An inlet 82 formed through the structure of a lower head fitting 83 provides a fluid inlet for production fluids to enter the pumping system 50 from the wellbore 5.

One of the many advantages of the pumping system disclosed herein is the modular ability to create the pumping system from independent stand alone elements. Previously known pumping systems having a recirculation element or recirculation function required a dedicated discharge head in a corresponding recirculation pump that directed recirculation flow upstream of the pump motor. The modular configuration disclosed herein comprises independent stand alone elements that do not require the dedicated machining and design of the recirculation discharge head. The recirculating pumping system described herein can easily be produced by using off the shelf components that do not require specific machining.

In the embodiments discussed, stage compression of the lower pump may be achieved by use of a compressible member, i.e., a wave washer that would be compressed to apply a force to a diffuser stack and would accommodate differences in diffuser stack and/or housing lengths due to manufacturing tolerances. Also, a bearing spider may be installed for compressing the diffuser stack in the lower pump.

In one optional embodiment, a recirculation system of the present disclosure is formed by retrofitting a multi-stage pumping system. A multi-stage pumping system includes two or more dedicated individual pumps coaxially disposed at different locations along the axis of the pumping system. A recirculation coupling in accordance with that disclosed herein may be inserted in the space between the severed pumps. In this embodiment the circulation coupling will have its intake and exit coupled with the respective severed ends of the multistage pumping system. By coupling the recirculation coupling with the severed ends, an integrated recirculation pumping system may be formed for insertion into and operation within a wellbore. A retrofit kit could be developed that includes all of the components needed to convert an on the shelf standard pump for recirculation applications.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

The invention claimed is:

1. A downhole submersible pumping system disposable in a wellbore comprising:

a lower having a discharge and an intake;

a recirculation coupling connected with the discharge of the lower pump;

an upper pump having a discharge and an intake in fluid communication with the discharge of the lower pump through the recirculation coupling;

a pump motor assembly connected below the lower pump for driving the pumps;

a pump system fluid inlet in fluid communication with the lower pump intake and the upper pump intake;

a drive shall extending from the assembly through the lower pump, the recirculation coupling, and the upper pump;

a recirculation line having an intake in fluid communication with the recirculation coupling and an exit configured to discharge fluid from the recirculation line across the pump motor assembly; and a bore extending through the coupling with a lower portion converging radially inward and a shaft through the bore defining an annular space between the shaft and the bore.

2. The pumping system of claim 1, wherein each of the pumps has a tubular housing and the recirculation coupling is secured to the housings.

3. The pumping system of claim 1, wherein the drive shaft comprises a single unitary drive shaft that extends through the lower pump.

4. The pumping system of claim 1, wherein the drive shaft comprises separate drive shafts for the upper and lower pumps coupled together in the recirculation coupling.

5. The pumping system of claim 1, wherein each of the upper and lower pumps has a housing, wherein the upper pump housing has a set of internal threads at the upper pump intake, wherein the lower pump housing has internal threads at the discharge, and mating threads on upper and lower ends of the recirculation coupling.

6. The pumping system of claim 1, wherein the recirculation coupling is configured to direct a portion of fluid received from the lower pump discharge and to the upper pump intake and the remaining portion of the received flow to the recirculation line.

7. The pumping system of claim 6, wherein the portion of the fluid received from the upper pump intake is pumpable by the upper pump to an upper end of the wellbore.

8. The pumping system of claim 1 further comprising a spider bearing coupled to the drive shaft within the lower pump.

9. The pumping system of claim 1 further comprising a spider bearing in the recirculation coupling for supporting said at least one drive shaft.

10. A downhole submersible pumping system disposable in a cased wellbore comprising:

a lower pump;

an upper pump, wherein the upper and lower pumps are centrifugal pumps;

a pump assembly having a housing and a pump motor, wherein the pump motor is coupled to the pumps by a drive shaft;

a recirculation coupling having an end affixed to the lower pump exit and an end affixed to the upper pump suction;

mating threads correspondingly formed on the upper and lower pumps and recirculation coupling;

a pump system fluid inlet formed in the pump system housing configured to provide wellbore production fluid from the wellbore to the intake of both the upper and lower pumps;

a recirculation line formed to receive fluid from the recirculation coupling and discharge fluid proximate to the pump assembly, wherein the discharge fluid flows across the pump housing, wherein a portion of the wellbore production fluid flowing through the pump system fluid inlet is directed to the recirculation line, and the remaining portion is directed through the recirculation coupling to the upper pump inlet for delivery further up the wellbore; and a bore extending through the coupling, the bore having a converging lower portion.

11. The system of claim 10, wherein the drive shaft comprises a single unitary drive shaft that extends through the lower pump.

12. The system of claim 10, wherein the drive shaft comprises separate drive shafts for the upper and lower pumps coupled together in the recirculation coupling.

13. The system of claim 10, further comprising a spider bearing coupled to the drive shaft within the lower pump.

14. The system of claim 10, further comprising a spider bearing in the recirculation coupling for supporting the drive shaft.

* * * * *

UNITED STATES PATENT AND TRADEMARK OFFICE

CERTIFICATE OF CORRECTION

PATENT NO. : 7,841,395 B2
APPLICATION NO. : 11/962993
DATED : November 30, 2010
INVENTOR(S) : Farral D. Gay et al.

It is certified that error appears in the above-identified patent and that said Letters Patent is hereby corrected as shown below:

Column 6, line 4, insert --pump-- after "lower"

Signed and Sealed this
Tenth Day of May, 2011

David J. Kappos

David J. Kappos
*Director of the United States Patent and Trademark Office*